US011328668B2

(12) United States Patent
Chen et al.

(10) Patent No.: US 11,328,668 B2
(45) Date of Patent: May 10, 2022

(54) PIXEL CIRCUIT AND DRIVING METHOD THEREOF, AND DISPLAY PANEL

(71) Applicants: Hefei Xinsheng Optoelectronics Technology Co., Ltd., Anhui (CN); BOE Technology Group Co., Ltd., Beijing (CN)

(72) Inventors: Peng Chen, Beijing (CN); Zixuan Wang, Beijing (CN)

(73) Assignees: Hefei Xinsheng Optoelectronics Technology Co., Ltd., Anhui (CN); BOE Technology Group Co., Ltd., Beijing (CN)

( * ) Notice: Subject to any disclaimer, the term of this patent is extended or adjusted under 35 U.S.C. 154(b) by 378 days.

(21) Appl. No.: 16/478,419

(22) PCT Filed: Oct. 17, 2018

(86) PCT No.: PCT/CN2018/110673

§ 371 (c)(1),
(2) Date: Jul. 16, 2019

(87) PCT Pub. No.: WO2019/174228

PCT Pub. Date: Sep. 19, 2019

(65) Prior Publication Data

US 2021/0335247 A1 Oct. 28, 2021

(30) Foreign Application Priority Data

Mar. 12, 2018 (CN) ..... 201810201169.1

(51) Int. Cl.
*G09G 3/3258* (2016.01)
*G09G 3/3241* (2016.01)

(52) U.S. Cl.
CPC ... *G09G 3/3241* (2013.01); *G09G 2300/0852* (2013.01); *G09G 2320/045* (2013.01)

(58) Field of Classification Search
None
See application file for complete search history.

(56) References Cited

U.S. PATENT DOCUMENTS 8,933,973 B2 1/2015 Mizukoshi et al.
2006/0187154 A1 8/2006 Tsuchida
2018/0033371 A1* 2/2018 Chen ..... G09G 3/3266

FOREIGN PATENT DOCUMENTS

CN 102402940 A 4/2012
CN 102405492 A 4/2012
(Continued)

*Primary Examiner* — Carl Adams
(74) *Attorney, Agent, or Firm* — Banner & Witcoff, Ltd.

(57) ABSTRACT

A pixel circuit and a driving method thereof, and a display panel. The pixel circuit includes a driver circuit, a data writing circuit, a storage circuit, a light emitting element and a bias circuit. The driver circuit controls a drive current for driving the light emitting element to emit light. The data writing circuit writes a data signal to the control terminal of the driver circuit in response to a scan signal. The storage circuit stores the data signal written by the data writing circuit. The light emitting element emits light according to the drive current. The bias circuit applies a bias voltage to the second terminal of the light emitting element in response to a bias starting signal and according to a bias voltage amplitude signal, so as to reverse bias the light emitting element.

19 Claims, 8 Drawing Sheets

(56) References Cited

FOREIGN PATENT DOCUMENTS

| | | | |
|---|---|---|---|
| CN | 102483654 | A | 5/2012 |
| CN | 103915057 | A | 7/2014 |
| CN | 105047138 | A | 11/2015 |
| CN | 108376534 | A | 8/2018 |
| CN | 207966467 | U | 10/2018 |

* cited by examiner

PIXEL CIRCUIT AND DRIVING METHOD THEREOF, AND DISPLAY PANEL

The application is a U.S. National Phase Entry of International Application No. PCT/CN2018/110673 filed on Oct. 17, 2018, designating the United States of America and claiming priority to Chinese Patent Application No. 201810201169.1, filed on Mar. 12, 2018. The present application claims priority to and the benefit of the above-identified applications and the above-identified applications are incorporated by reference herein in their entirety.

TECHNICAL FIELD

The embodiments of the present disclosure relate to a pixel circuit and a driving method thereof, and a display panel.

BACKGROUND

Due to its advantages of a wide viewing angle, high contrast, a fast response speed as well as higher luminance and a lower drive voltage than an inorganic light emitting display device, an organic light emitting diode (OLED) display device is increasingly focused. Due to the above-mentioned characteristics, the OLED may be applied to devices with a display function, such as a mobile phone, a display, a laptop, a digital camera, a navigator or the like.

Usually, the pixel circuit in an OLED display device usually adopts a matrix-driven manner, which may be divided into an AM (active matrix)-driven manner and a PM (passive matrix)-driven manner according to whether there is a switch element introduced in each pixel unit. In spite of its simple process and low costs, a PMOLED cannot meet the requirement of a high-resolution and large-size display due to its disadvantages of cross talk, high power consumption, short service life, or the like. By contrast, in the AMOLED, generally, a group of thin film transistor and a storage capacitor are integrated in the pixel circuit of each pixel. With the drive control over the thin film transistors and the storage capacitor, the control over the current flowing through the OLED is implemented, thereby making the OLED emit light as required. Compared with the PMOLED, the AMOLED requires a small drive current and has low power consumption and a longer service life, so may meet the requirements of high-resolution, multi-gray-level and large-size display. Also, the AMOLED has obvious advantages in terms of viewing angle, color rendition, power consumption and response time, and is suitable for the display device with rich information content and high resolution.

SUMMARY

At least one embodiment of the present disclosure provides a pixel circuit, which comprises a driver circuit, a data writing circuit, a storage circuit, a light emitting element and a bias circuit; wherein the driver circuit comprises a control terminal, a first terminal and a second terminal, and the driver circuit is configured to control a drive current for driving the light emitting element to emit light, the second terminal of the driver circuit receives a first voltage signal of a first voltage terminal;

the data writing circuit is connected with the control terminal of the driver circuit, and the data writing circuit is configured to write a data signal to the control terminal of the driver circuit in response to a scan signal;

a first terminal of the storage circuit is connected with the control terminal of the driver circuit, a second terminal of the storage circuit is connected with the first terminal of the driver circuit, and the storage circuit is configured to store the data signal written by the data writing circuit;

a first terminal of the light emitting element receives a second voltage signal of a second voltage terminal, a second terminal of the light emitting element is connected with the first terminal of the driver circuit, and the light emitting element is configured to emit light according to the drive current; and the bias circuit is connected with the second terminal of the light emitting element, and the bias circuit is configured to apply according to a bias voltage amplitude signal a bias voltage to the second terminal of the light emitting element in response to a bias starting signal, so as to reverse bias the light emitting element.

For example, in the pixel circuit according to an embodiment of the present disclosure, the bias circuit comprises a first capacitor and a first transistor;

a first electrode of the first capacitor is configured to be connected with the second terminal of the light emitting element, and a second electrode of the first capacitor is configured to be connected with a first electrode of the first transistor; and a gate of the first transistor is configured to be connected with a bias starting terminal to receive the bias starting signal, and a second electrode of the first transistor is configured to be connected with a bias voltage amplitude terminal to receive the bias voltage amplitude signal.

For example, in the pixel circuit according to an embodiment of the present disclosure, the driver circuit comprises a second transistor;

a gate of the second transistor is used as the control terminal of the driver circuit; a first electrode of the second transistor is used as the first terminal of the driver circuit; and a second electrode of the second transistor is used as the second terminal of the driver circuit.

For example, in the pixel circuit according to an embodiment of the present disclosure, the data writing circuit comprises a third transistor;

a gate of the third transistor is configured to be connected with a scan signal terminal to receive the scan signal, a first electrode of the third transistor is configured to be connected with a data signal terminal to receive the data signal, and a second electrode of the third transistor is configured to be connected with the control terminal of the driver circuit.

For example, in the pixel circuit according to an embodiment of the present disclosure, the storage circuit comprises a second capacitor;

a first electrode of the second capacitor is used as the first terminal of the storage circuit, and a second electrode of the second capacitor is used as the second terminal of the storage circuit.

For example, the pixel circuit according to an embodiment of the present disclosure further comprises a reset circuit, wherein the reset circuit is connected with the control terminal of the driver circuit, and the reset circuit is configured to apply a reset voltage to the control terminal of the driver circuit in response to a reset signal.

For example, in the pixel circuit according to an embodiment of the present disclosure, the reset circuit comprises a fourth transistor;

a gate of the fourth transistor is configured to be connected with a reset terminal to receive the reset signal, a first electrode of the fourth transistor is connected with the control terminal of the driver circuit, and a second electrode of the fourth transistor is configured to be connected with the first voltage terminal to receive the reset voltage.

For example, the pixel circuit according to an embodiment of the present disclosure further comprises a light emitting control circuit, wherein the light emitting control circuit is connected with the first terminal of the light emitting element, and the light emitting control circuit is configured to apply the second voltage signal of the second voltage terminal to the first terminal of the light emitting element in response to a light emitting control signal.

For example, in the pixel circuit according to an embodiment of the present disclosure, the light emitting control circuit comprises a fifth transistor;

a gate of the fifth transistor is configured to be connected with a light emitting control terminal to receive the light emitting control signal, a first electrode of the fifth transistor is configured to be connected with the second voltage terminal to receive the second voltage signal, and a second electrode of the fifth transistor is configured to be connected with the first terminal of the light emitting element.

At least one embodiment of the present disclosure further provides a display panel, which comprises a plurality of pixel units arranged in an array, and the pixel unit comprises the pixel circuit according to any one of the embodiments of the present disclosure.

For example, the display panel according to an embodiment of the present disclosure further comprises a plurality of scan lines, wherein the data writing circuit in a Nth row of the pixel circuits is connected with the scan line in a Nth row to receive the scan signal, and the bias circuit in the Nth row of the pixel circuits is connected with the scan line in a (N−1)th row to receive the scan signal of the (N−1)th row as the bias starting signal and/or the bias voltage amplitude signal, wherein N is an integer greater than 1.

For example, in the display panel according to an embodiment of the present disclosure, a reset circuit in the Nth row of the pixel circuits is connected with the scan line in a (N−2)th row to receive the scan signal of the (N−2)th row as the reset signals, and N is an integer greater than 2.

At least one embodiment of the present disclosure further provides a method for driving the pixel circuit according to any one of the embodiments of the present disclosure, which comprises a bias stage and a data writing stage; wherein at the bias stage, inputting the bias starting signal to switch on the bias circuit, and applying, by the bias circuit, the bias voltage to the second terminal of the light emitting element according to the bias voltage amplitude signal, so as to reverse bias the light emitting element; and at the data writing stage, inputting the scan signal and the data signal to switch on the data writing circuit and the driver circuit, writing, by the data writing circuit, the data signal to the driver circuit, storing the data signal by the storage circuit, and emitting light by the light emitting element according to the drive current.

For example, in the method for driving the pixel circuit according to an embodiment of the present disclosure, in a case where the pixel circuit further comprises a reset circuit, the method further comprises a reset stage; wherein at the reset stage, inputting a reset signal to switch on the reset circuit, applying, by the reset circuit, a reset voltage to the control terminal of the driver circuit and the first terminal of the storage circuit, so as to reset the driver circuit and the storage circuit.

At least one embodiment of the present disclosure further provides a method for driving the pixel circuit according to any one of the embodiments of the present disclosure, which comprises a bias stage, a data writing stage and a light emitting stage; wherein at the bias stage, inputting the bias starting signal to switch on the bias circuit, applying, by the bias circuit, the bias voltage to the second terminal of the light emitting element according to the bias voltage amplitude signal, so as to reverse bias the light emitting element;

at the data writing stage, inputting the scan signal and the data signal to switch on the data writing circuit, writing, by the data writing circuit, the data signal to the driver circuit, and storing the data signal by the storage circuit stores; and at the light emitting stage, inputting the light emitting control signal switch on the light emitting control circuit, and applying, by the light emitting control circuit and the driver circuit, the drive current to the light emitting element to make the light emitting element emit light.

BRIEF DESCRIPTION OF THE DRAWINGS

In order to clearly illustrate the technical solution of the embodiments of the present disclosure, the drawings of the embodiments will be briefly described in the following; it is obvious that the described drawings are only related to some embodiments of the present disclosure and thus are not limitative of the present disclosure.

DETAILED DESCRIPTION

Figure 1:
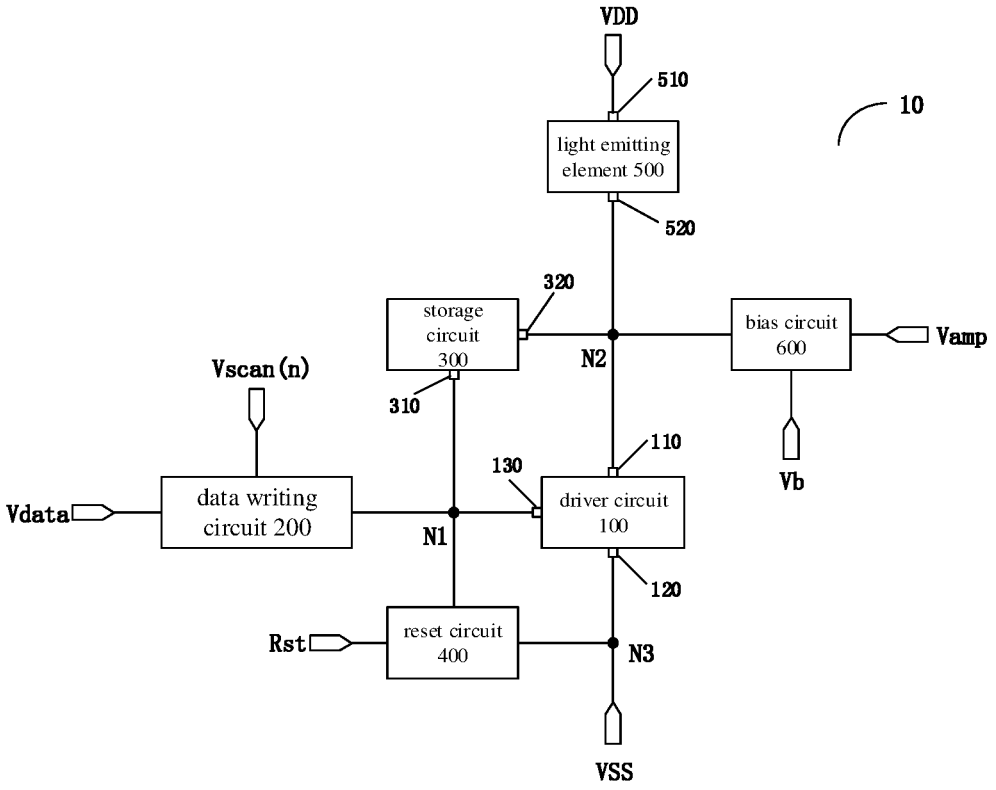
FIG. 1 is a schematic block diagram of a pixel circuit according to an embodiment of the present disclosure.

In order to make objects, technical details and advantages of the embodiments of the present disclosure apparent, the technical solutions of the embodiments will be described in a clearly and fully understandable way in connection with the drawings related to the embodiments of the present disclosure. Apparently, the described embodiments are just a part but not all of the embodiments of the present disclosure. Based on the described embodiments herein, those skilled in the art can obtain other embodiment(s), without any inventive work, which should be within the scope of the present disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for invention, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

In the fields of display and lighting, a service life of an OLED device has been always a concern of each manufacturer. As a self-luminous device, the OLED would age during its light emitting process, which results in a decrease in the brightness. An aging mechanism of the OLED is related to various factors, such as an inherent defect of the device, and the degradation of the OLED device. In the field of AMOLED display, there are various pixel circuits for driving the OLED, for example, a 2T1C circuit consisting of two thin film transistors (TFT) and one capacitor (C), or a 4T1C circuit and a 4T2C circuit with a function of compensating a threshold voltage, etc. These pixel circuits cannot improve the aging of the OLED device, and the service life of the OELD device cannot be prolonged effectively.

At least one embodiment of the present disclosure provides a pixel circuit and a driving method thereof, and a display panel. A reverse voltage may be applied to this pixel circuit after the OLED emits light, which facilitates the elimination of defects of the OLED accumulated at the stage when forward voltages are applied, thereby improving the aging of the OLED device and prolonging the service life of the OLED device. In the case where this pixel circuit is applied to the display panel, there is no need to provide any new signal for the display panel, and thus the display panel is easy to implement and the service life of the display panel may be prolonged.

The embodiments of the present disclosure will be described below in detail with reference to the accompany drawings. It should be noted that the same reference numeral in different drawings refers to the same described element that has been described.

At least one embodiment of the present disclosure provides a pixel circuit, including a driver circuit, a data writing circuit, a storage circuit, a light emitting element and a bias circuit. The driver circuit includes a control terminal, a first terminal and a second terminal and is configured to control a drive current for driving the light emitting element to emit light, and a second terminal of the driver circuit receives a first voltage signal of a first voltage terminal. The data writing circuit is connected with the control terminal of the driver circuit, and is configured to write a data signal to the control terminal of the driver circuit in response to a scan signal. A first terminal of the storage circuit is connected with the control terminal of the driver circuit, a second terminal of the storage circuit is connected with the first terminal of the driver circuit, and the storage circuit is configured to store the data signal written by the data writing circuit. A first terminal of the light emitting element receives a second voltage signal of a second voltage terminal, a second terminal of the light emitting element is connected with the first terminal of the driver circuit, and the light emitting element is configured to emit light according to the drive current. The bias circuit is connected with the second terminal of the light emitting element and is configured to apply a bias voltage to the second terminal of the light emitting element in response to a bias starting signal and according to a bias voltage amplitude signal, so as to reverse bias the light emitting element.

FIG. 1 is a schematic block diagram of a pixel circuit according to an embodiment of the present disclosure. Referring to FIG. 1, the pixel circuit 10 includes a driver circuit 100, a data writing circuit 200, a storage circuit 300, a reset circuit 400, a light emitting element 500 and a bias circuit 600. The pixel circuit 10 is for example, configured to be used for a subpixel of an OLED display device.

For example, the driver circuit 100 includes a first terminal 110, a second terminal 120 and a control terminal 130. The driver circuit 100 is configured to control a drive current for driving the light emitting element 500 to emit light. The second terminal 120 of the driver circuit 100 receives a first voltage signal of the first voltage terminal VSS. The control terminal 130 of the driver circuit 100 is connected with a first node N1, the first terminal 110 of the driver circuit 100 is connected with a second node N2, and the second terminal 120 of the driver circuit 100 is connected with the first voltage terminal VSS (third node N3) to receive the first voltage signal. For example, the driver circuit 100 may provide the drive current for the light emitting element 500 to drive the light emitting element 500 to emit light according to a required "gray level". For example, as the light emitting element 500, an OLED may be used, and the light emitting element 500 is configured to be connected with the second node N2 and the second voltage terminal VDD (for example, a high level), and the embodiment of the present disclosure includes, but not limited to this situation.

For example, the data writing circuit 200 is connected with the control terminal 110 (first node N1) of the driver circuit 100, and is configured to write the data signal to the control terminal 130 of the driver circuit 100 in response to the scan signal. For example, the data writing circuit 200 is connected with the data signal terminal Vdata, the first node N1 and the scan signal terminal Vscan(n). For example, the scan signal from the scan signal terminal Vscan(n) is applied to the data writing circuit 200, so as to control the data writing circuit 200 to switch on or off. For example, at a data writing stage, the data writing circuit 200 may be switched on in response to the scan signal, thereby writing the data signal to the control terminal 130 (second node N2) of the driver circuit 100, and storing the data signal in the storage circuit 300 so as to generate according to the data signal the drive current for driving the light emitting element 500 to emit light.

For example, the first terminal 310 of the storage circuit 300 is connected with the control terminal 130 (first node N1) of the driver circuit 100, the second terminal 320 of the storage circuit 300 is connected with the first terminal 110 (second node N2) of the driver circuit 100, and the storage circuit 300 is configured to store the data signal written by the data writing circuit 200. For example, the storage circuit 300 may store the data signal and control the driver circuit 100 by using the stored data signal.

For example, the reset circuit 400 is connected with the control terminal 130 (first node N1) of the driver circuit 100, and is configured to apply a reset voltage to the control terminal 130 of the driver circuit and the first terminal 310 of the storage circuit 300 in response to the reset signal. For example, the reset circuit 400 is connected with the first node N1, the first voltage terminal VSS (third node N3) and the reset terminal Rst. For example, the reset circuit 400 may be switched on in response to the reset signal, thereby applying the reset voltage (the voltage for resetting herein is the first voltage signal) to the first node N1, the first terminal 310 of the storage circuit 300 and the control terminal 130 of the driver circuit 100 to reset the storage circuit 300 and the driver circuit 100 and eliminate the influence of the former light emitting stage. For example, the reset voltage may be provided by the first voltage terminal VSS. In other embodiments, the reset voltage may also be provided by a reset voltage terminal which is independent of the first voltage terminal VSS. Correspondingly, the reset circuit 400 is not connected with the first voltage terminal VSS (third node N3), but is connected with this reset voltage terminal, the embodiments of the present disclosure are not limited thereto. For example, the first voltage terminal VSS is a low voltage terminal, for example, a grounded terminal. For example, according to a circuit structure, the reset circuit 400 may also be omitted or integrated into other circuits.

For example, in a display device, when the pixel circuits 10 are arranged in an array, the data writing circuit 200 in the Nth row (N is an integer greater than 2) are connected with a scan line in the Nth row (or a scan signal terminal Vscan(n)) to receive the scan signal, and the reset circuit 400 in the Nth row are connected with a scan line in the (N−2)th row (or a scan signal terminal Vscan(n−2)) to receive the scan signal in the (N−2)th row as the reset signal. Compared with a traditional display panel, in this way, there is no need to provide any new signals, and the circuit structure is simple and easy to implement. Certainly, the embodiments of the present disclosure are not limited thereto. The reset circuit 400 may also be connected with an additional reset signal line to receive an additional reset signal.

For example, the light emitting element 500 includes a first terminal 510 and a second terminal 520, and the light emitting element 500 is configured to emit light according to the drive current provided by the driver circuit 100. The first terminal 510 of the light emitting element 500 is configured to receive the second voltage signal of the second voltage terminal VDD, and the second terminal 520 of the light emitting element 500 is configured to be connected with the first terminal 110 (second node N2) of the driver circuit 100.

For example, the bias circuit 600 is connected with the second terminal 520 (second node N2) of the light emitting element 500, and the bias circuit 600 is configured to apply a bias voltage to the second terminal 520 of the light emitting element 500 in response to a bias starting signal and according to a bias voltage amplitude signal, so as to reverse bias the light emitting element 500. For example, the bias circuit 600 is connected with the second node N2, a bias starting terminal Vb and a bias voltage amplitude terminal Vamp. For example, the bias circuit 600 may be switched on in response to the bias starting signal provided by the bias starting terminal Vb, thereby applying a bias voltage to the second terminal 520 of the light emitting element 500 according to the bias voltage amplitude signal provided by the bias voltage amplitude terminal Vamp. For example, the bias voltage may not be equal to the bias voltage amplitude signal. After the light emitting element 500 (for example, OLED) emits light, the bias voltage is applied to the light emitting element, so as to reverse bias the light emitting element, which may facilitate the elimination of defects accumulated by the light emitting element 500 at a stage when forward voltages are applied (for example, the light emitting stage), thereby improving the aging of the light emitting element 500 and prolonging the service life of the light emitting element 500.

For example, the bias starting terminal Vb and the bias voltage amplitude terminal Vamp may be connected with the same signal line, thereby making the bias starting signal and the bias amplitude signal become the same signal, and simplifying the design of the circuit. For example, in a display device, when the pixel circuits 10 are arranged in an array, the data writing circuits 200 in the Nth row (N is an integer greater than 1) are connected with a scan line in the Nth row (or a scan signal terminal Vscan(n)) to receive the scan signal, and the bias circuits 600 in the Nth row are connected with a scan line in the (N−1)th row (or a scan signal terminal Vscan(n−1)) to receive the scan signals in the (N−1)th row as the bias starting signal and/or the bias voltage amplitude signal. By using the scan signals of the pixel circuit 10, compared with a traditional display panel, there is no need to provide any new signals, and the circuit structure is simple and easy to implement. Certainly, the embodiments of the present disclosure are not limited thereto. The bias circuit 600 may also be connected with additional bias starting signal lines and/or bias voltage amplitude signal lines to receive additional bias starting signals and/or bias amplitude signals.

Figure 2:
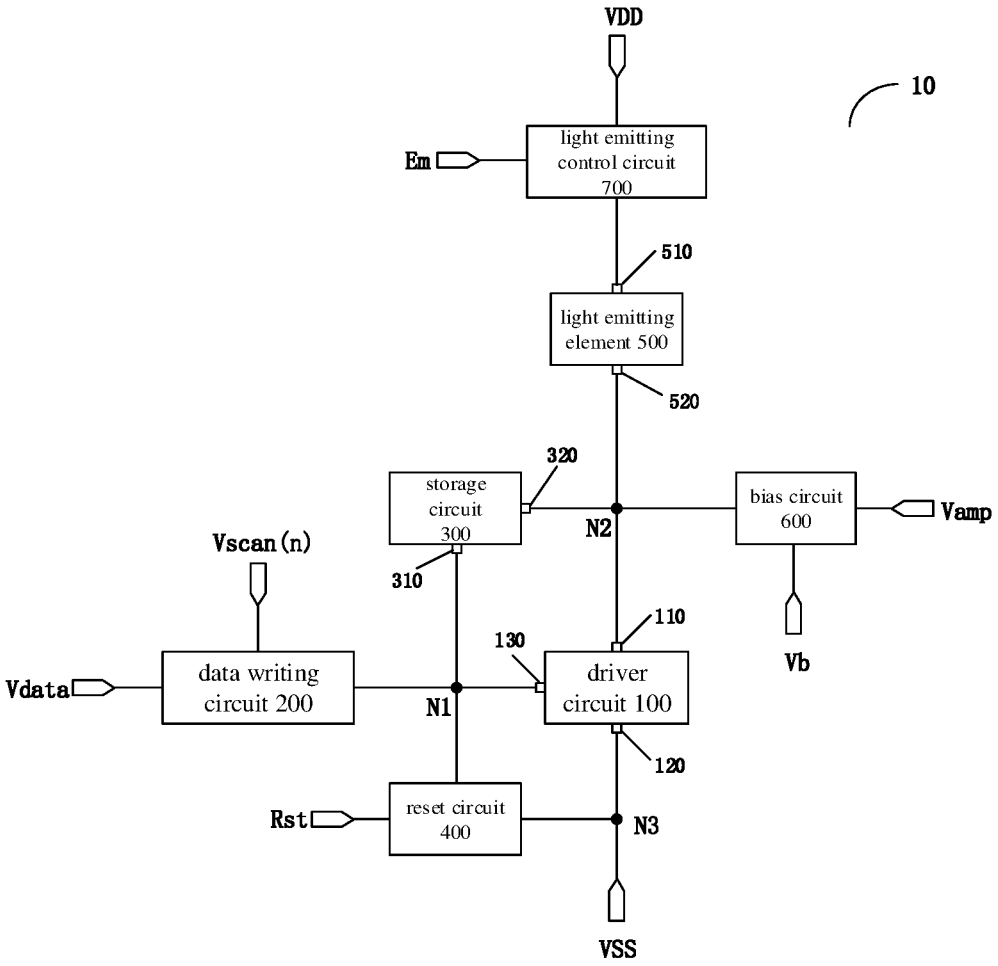
FIG. 2 is a schematic block diagram of another pixel circuit according to an embodiment of the present disclosure.

FIG. 2 is a schematic block diagram of another pixel circuit according to an embodiment of the present disclosure. Referring to FIG. 2, the pixel circuit 10 may further include a light emitting control circuit 700, and the remaining structure is the same as that of the pixel circuit 10 shown in FIG. 1. The light emitting control circuit 700 is connected with the first terminal 510 of the light emitting element 500, and is configured to apply the second voltage signal of the second voltage terminal VDD to the first terminal 510 of the light emitting element 500 in response to the light emitting control signal. For example, the light emitting control circuit 700 is connected with the second voltage terminal VDD, the light emitting control terminal Em, and the first terminal 510 of the light emitting element 500. For example, at the light emitting stage, the light emitting control circuit 700 is switched on in response to the light emitting control signal provided by the light emitting control terminal Em, so that the driver circuit 100 may apply the drive current to the light emitting element 500 to make light emitting element 500 emit light by the light emitting control circuit 700; at a non-light emitting stage, the light emitting control circuit 700 is switched off in response to the light emitting control signal, thereby preventing current from flowing through the light emitting element 500 to make the light emitting element 500 emit light, and improving the contrast of the corresponding display device.

For example, in the case where the driver circuit 100 is implemented by a driver transistor, a gate of the driver transistor may be used as the control terminal 130 (connected to the first node N1) of the driver circuit 100, the first electrode (for example, a source) may be used as the first terminal 110 (connected to the second node N2) of the driver circuit 100, and the second electrode (for example, a drain) may be used as the second terminal 120 (connected to the third node N3) of the driver circuit 100.

It should be noted that the first voltage terminal VSS according to each embodiment of the present disclosure, for example, keeps inputting a DC low-level signal which is referred to as a first voltage (also referred as a reset voltage); the second voltage terminal VDD, for example, keeps inputting a DC high-level signal which is referred to as a second voltage higher than the first voltage. The following embodiments are the same in this aspect, and the repeated descriptions are omitted herein.

It should be noted that in the description of each embodiment of the present disclosure, Vdata may represent not only a data signal terminal but also a level of the data signal. Similarly, Rst may represent not only the reset terminal but also the level of the reset signal, VSS may represent not only the first voltage terminal but also the first voltage, VDD may represent not only the second voltage terminal but also the second voltage, Vb may represent not only the bias starting terminal but also the level of the bias starting signal, and Vamp may represent not only the bias voltage amplitude terminal but also the level of the bias voltage amplitude signal. The following embodiments are the same in this aspect, and the repeated descriptions are omitted herein.

It should be noted that the pixel circuit 10 according to each embodiment of the present disclosure may further include other circuit structures with a compensation function. The compensation function may be implemented by voltage compensation, current compensation or mixed compensation, and the pixel circuit 10 with the compensation function may be a combination of a circuit such as the 4T1C circuit or the 4T2C circuit with the bias circuit 600. For example, in the pixel circuit 10 with the compensation function, the data writing circuit 200 and a compensation circuit cooperate to write a voltage value carrying the data signal and threshold voltage information of the driver transistor in the driver circuit 100 to the control terminal 130 of the driver circuit 100 and the voltage value is stored in the storage circuit 300. The particular compensation circuit is not described in detail herein.

After the light emitting element 500 emits light, a reverse voltage is applied to the pixel circuit 10 according to the embodiments of the present disclosure, which facilitates elimination of defects of the light emitting element 500 accumulated at the stage when forward voltages are applied, thereby improving the aging of the light emitting element 500 and prolonging the service life of the light emitting element 500. In the case where this pixel circuit 10 is applied to a display panel, there is no need to provide any new signals for the display panel, so the display panel is easy to implement.

Figure 3:
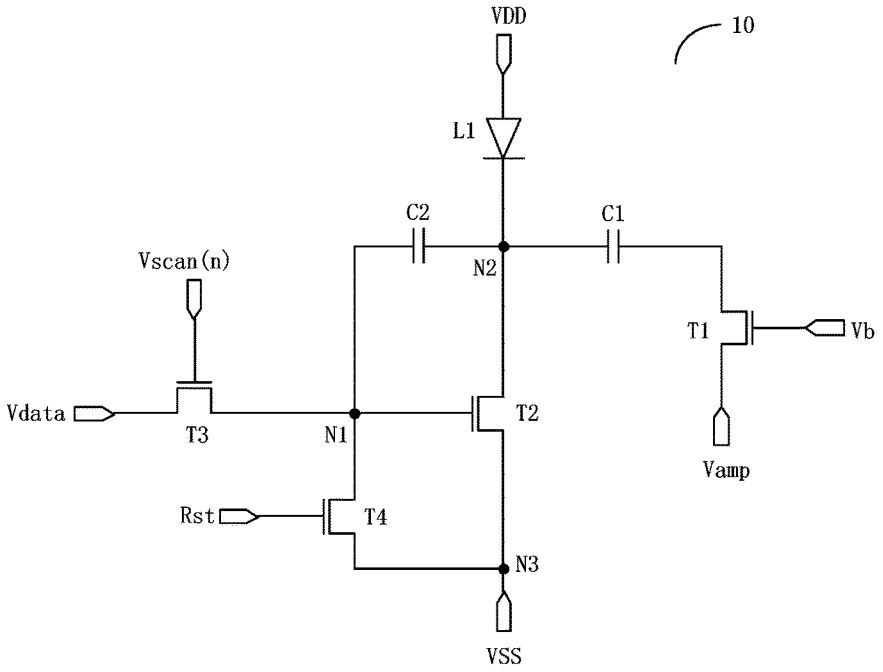
FIG. 3 is a circuit diagram of a particular implementation example of the pixel circuit shown in FIG. 1.

FIG. 3 is a circuit diagram of a particular implementation example of the pixel circuit shown in FIG. 1. Referring to FIG. 3, the pixel circuit 10 includes first to fourth transistors T1, T2, T3, T4 and a first capacitor C1, a second capacitor C2 and a light emitting element L1. For example, the second transistor T2 is used as the driver transistor, and the other transistors are used as switch transistors. For example, the light emitting element L1 may be an OLED of any type, for example, top emitting, bottom emitting, and double-side emitting, or the like, may emit red light, green light, blue light, white light, or the like, and the embodiments of the present disclosure has no limitation in this aspect.

For example, as shown in FIG. 3, the bias circuit 600 may be implemented as the first capacitor C1 and a first transistor T1. A first electrode of the first capacitor C1 is configured to be connected with the second terminal 520 (second node N2) of the light emitting element L1, and a second electrode of the first capacitor C1 is configured to be connected with the first electrode of the first transistor T1. A gate of the first transistor T1 is configured to be connected with the bias starting terminal Vb to receive the bias starting signal, and the second electrode of the first transistor T1 is configured to be connected with the bias voltage amplitude terminal Vamp to receive the bias voltage amplitude signal. It should be noted that the bias circuit 600 is not limited thereto, but may be a circuit consisting of other components.

The driver circuit 100 may be embodied as a second transistor T2. A gate of the second transistor T2, which is used as the control terminal 130 of the driver circuit 100, is connected with the first node N1; a first electrode of the second transistor T2, which is used as the first terminal 110 of the driver circuit 100, is connected with the second node N2; a second electrode of the second transistor T2, which is used as the second terminal 120 of the driver circuit 100, is connected with the third node N3. It should be noted that the driver circuit 100 is not limited thereto, but may be a circuit consisting of other components. For example, the driver circuit 100 may have two groups of driver transistors, for example, which may be switched as required.

The data writing circuit 200 may be embodied as a third transistor T3. A gate of the third transistor T3 is configured to be connected with the scan signal terminal Vscan(n) to receive the scan signal, the first electrode of the third transistor T3 is configured to be connected with the data signal terminal Vdata to receive the data signal, and the second electrode of the third transistor T3 is configured to be connected with the first node N1. It should be noted that the data writing circuit 200 is not limited thereto, but may be a circuit consisting of other components.

The storage circuit 300 may be embodied as a second capacitor C2. A first electrode of the second capacitor C2, which is used as the first terminal 310 of the storage circuit 300, is configured to be connected with the first node N1, and a second electrode of the second capacitor C2, which is used as the second terminal 320 of the storage circuit 300, is configured to be connected with the second node N2. It should be noted that the storage circuit 300 is not limited thereto, but may also be a circuit consisting of other components. For example, the storage circuit 300 may include two capacitors connected in series/in parallel.

The reset circuit 400 may be embodied as a fourth transistor T4. A gate of the fourth transistor T4 is configured to be connected with the reset terminal Rst to receive the reset signal, a first electrode of the fourth transistor T4 is connected with the control terminal 130 (first node N1) of the driver circuit 100, and a second electrode of the fourth transistor T4 is configured to be connected with the first voltage terminal VSS (third node N3) to receive the first voltage signal (may be used as the reset voltage). It should be noted that the reset circuit 400 is not limited thereto, but may also be a circuit consisting of other components. For example, the reset circuit 400 may be also connected with the second terminal 520 of the light emitting element 500, for further resetting the second terminal 520 of the light emitting element 500 (not biased).

The light emitting element 500 may be embodied as the light emitting element L1 (for example, OLED). A first terminal (anode) of the light emitting element L1, which is used as the first terminal 510 of the light emitting element 500, is configured to be connected with the second voltage terminal VDD to receive the second voltage signal; a second terminal (cathode) of the light emitting element L1, which is used as the second terminal 520 of the light emitting element 500, is connected with the second node N2 and is configured to receive the drive current from the first terminal 110 of the driver circuit 100. For example, the second voltage terminal VDD keeps inputting the DC high-level signal, i.e., the VDD may have a high level. For example, in a display panel, when the pixel circuits 10 are arranged in an array, the anodes of the light emitting elements L1 may be electrically connected to the same voltage terminal, that is common-anode-connection manner.

It should be noted that in the explanation of the present disclosure, the first node N1, the second node N2 and the third node N3 do not represent actual parts, but represent related electric connection points in the circuit diagram.

Figure 4:
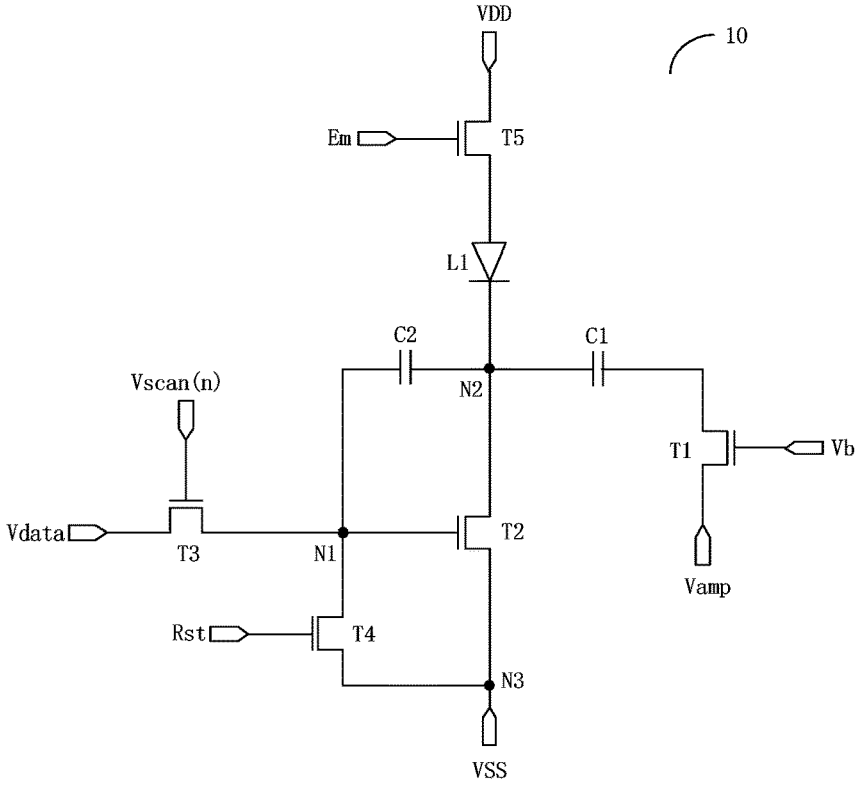
FIG. 4 is a circuit diagram of a particular implementation example of the pixel circuit shown in FIG. 2.

FIG. 4 is a circuit diagram of a particular implementation example of the pixel circuit shown in FIG. 2. The pixel circuit 10 shown in FIG. 4 is substantially the same as the pixel circuit 10 shown in FIG. 3 except that the pixel circuit 10 shown in FIG. 4 further includes a fifth transistor T5 to implement the light emitting control circuit 700.

For example, as shown in FIG. 4, the light emitting control circuit 700 may be embodied as a fifth transistor T5. A gate of the fifth transistor T5 is configured to be connected with the light emitting control terminal Em to receive the light emitting control signal, the first electrode of the fifth transistor T5 is configured to be connected with the second voltage terminal VDD to receive the second voltage signal, and the second electrode of the fifth transistor T5 is configured to be connected with the first terminal of the light emitting element L1. It should be noted that the light emitting control circuit 700 is not limited thereto, but may also be a circuit consisting of other components.

Figure 5:
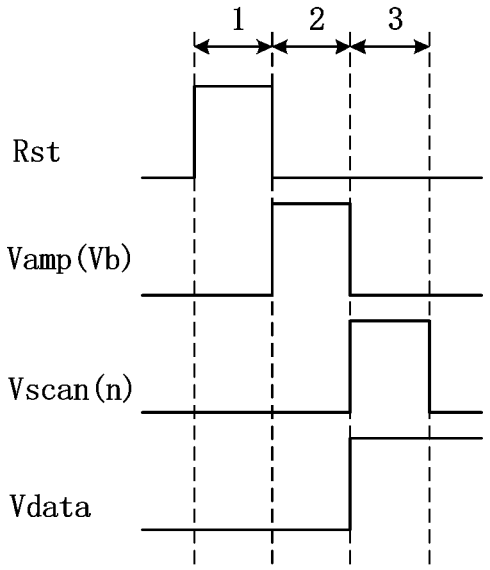
FIG. 5 is a signal timing diagram of a pixel circuit according to an embodiment of the present disclosure.

FIG. 5 is a signal timing diagram of a pixel circuit according to an embodiment of the present disclosure. The working principle of the pixel circuit 10 shown in FIG. 3 will be explained below in combination with the signal timing diagram shown in FIG. 5, and herein the description is made by taking an N-type transistor as an example, but the embodiments of the present disclosure are not limited thereto.

As shown in FIG. 5, a process for displaying each frame of image includes three stages: a reset stage 1, a bias stage 2, and a data writing stage 3. FIG. 5 shows the waveform of each signal at each stage.

Figure 6A:
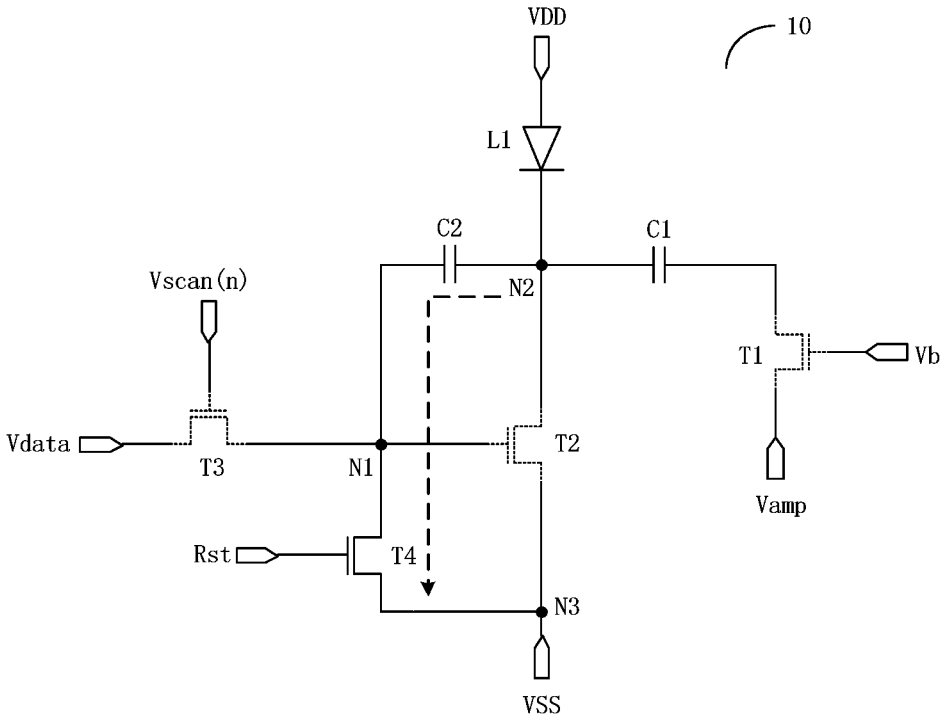
FIGS. 6A to 6C are schematic circuit diagrams of the pixel circuit shown in FIG. 3 corresponding to three stages in FIG. 5 respectively.
Figure 6B:
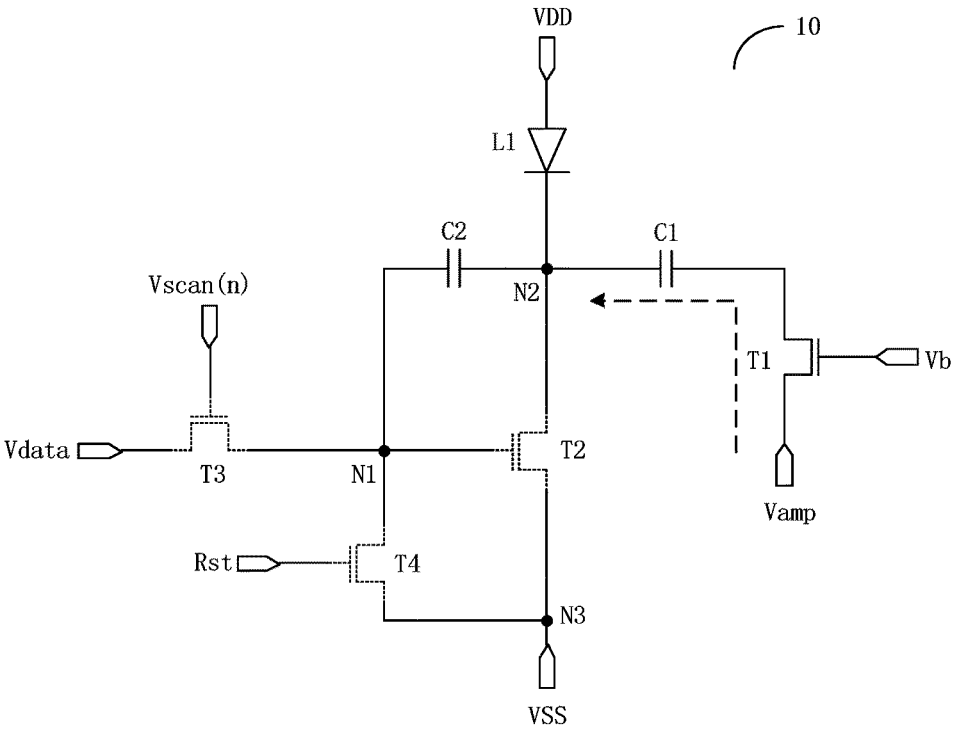
Figure 6C:
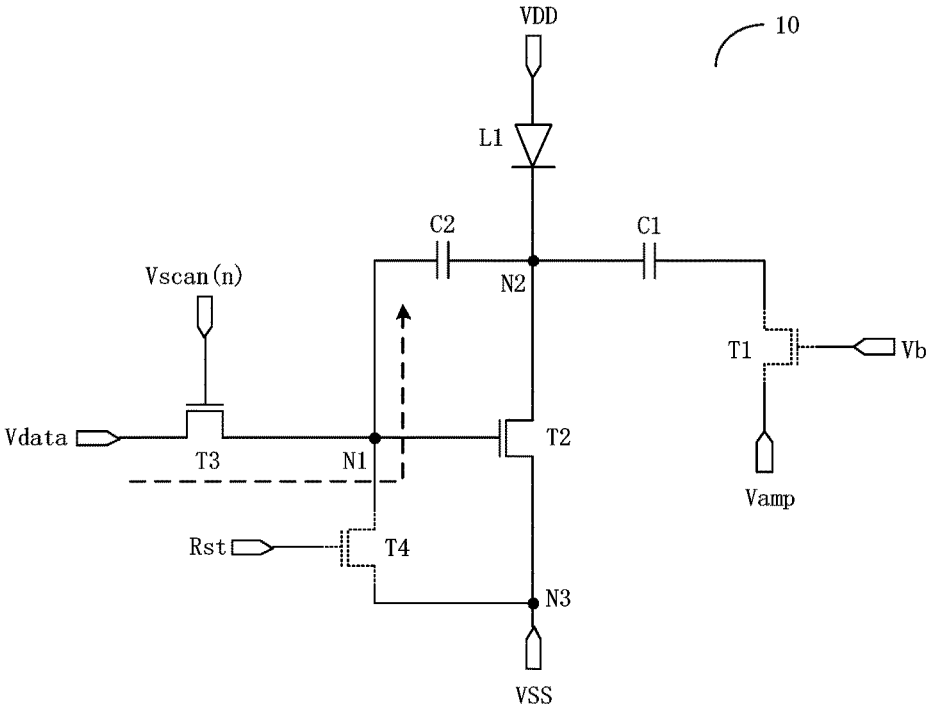

It should be noted that FIGS. 6A to 6C are schematic diagrams of the pixel circuit shown 10 shown in FIG. 3 at the above-mentioned three stages respectively. FIG. 6A is a schematic diagram of the pixel circuit 10 shown in FIG. 3 at the reset stage 1, FIG. 6B is a schematic diagram of the pixel circuit 10 shown in FIG. 3 at the bias stage 2, and FIG. 6C is a schematic diagram of the pixel circuit 10 shown in FIG. 3 at the data writing stage 3.

Additionally, in FIGS. 6A to 6C, the transistors shown by dashed lines mean that the transistors are in OFF states at the corresponding stage, and the dashed line with an arrow represents a direction of the current of the pixel circuit at the corresponding stage. In FIGS. 6A to 6C, the description is made by taking the transistors being N-type transistor as an example, i.e., the gate of each transistor is turned on in case of a high level being applied, and turned off in case of a low level being applied. The following embodiments are the same in this aspect, and the repeated descriptions are omitted herein.

At the reset stage 1, the reset signal (provided by the reset terminal Rst) is input to switch on the reset circuit 400, and the reset circuit 400 applies the reset voltage (provided by the first voltage terminal VSS) to the control terminal 130 of the driver circuit 100 and the first terminal 310 of the storage circuit 300, so as to reset the driver circuit 100 and the storage circuit 300.

As shown in FIGS. 5 and 6A, at the reset stage 1, the fourth transistor T4 is turned on by the high level of the reset signal; at the same time, the first transistor T1 is turned off by the low level of the bias starting signal, the third transistor T3 is turned off by the low level of the scan signal, and the second transistor T2 is turned off by the low level of the first node N1.

As shown in FIG. 6A, at the reset stage 1, a reset path (shown by a dashed line with an arrow in FIG. 6A) is formed. Since the fourth transistor T4 is turned on, the reset voltage is applied to the gate (first node N1) of the second transistor T2 and the first electrode of second capacitor C2. Since the reset voltage is a low-level signal (for example, may be grounded or other low-level signals), the second capacitor C2 is discharged through the reset path, thereby resetting the second transistor T2 and the second capacitor C2. For example, in a display device, when the pixel circuits 10 are arranged in an array, the gates of the third transistor T3 in the Nth row (N is an integer greater than 2) are connected with the scan line (or scan signal terminal Vscan (n)) in the Nth row to receive the scan signal, and the gates of the fourth transistors T4 in the Nth row are connected with the scan line (or scan signal terminal Vscan(n−2)) in the (N−2)th row to receive the scan signals in the (N−2)th row as the reset signal. Compared with a traditional display panel, in this way, there is no need to provide any new signals, and the circuit structure is simple and easy to implement.

After the reset stage 1, the potential of the first node N1 is that of the reset voltage. The second capacitor C2 is reset so that charges stored in the second capacitor C2 are discharged, thus the data signal at the subsequent stage may be stored in the second capacitor C2 more rapidly and reliably. Meanwhile, since the second transistor T2 is turned off, the light emitting element L1 is also reset, thereby making the light emitting element L1 in a black state before the data writing stage 3, that is, the light emitting element L1 does not emitting light, so as to improve the display effects such as the contrast of the display device which adopts the above-mentioned pixel circuit 10.

At the bias stage 2, the bias starting signal (provided by the bias starting terminal Vb) is input to switch on the bias circuit 600. The bias circuit 600 applies the bias voltage to the second terminal (second node N2) of the light emitting element L1 according to the bias voltage amplitude signal (provided by the bias voltage amplitude terminal Vamp), so as to reverse bias the light emitting element L1.

As shown in FIGS. 5 and 6B, at the reset stage 2, the first transistor T1 is turned on by the high level of the bias starting signal; at the same time, the second transistor T2 is turned off by the low level of the first node N1, the third transistor T3 is turned off by the low level of the scan signal, and the fourth transistor T4 is turned off by the low level of the reset signal.

As shown in FIG. 6B, at the bias stage 2, a bias path (shown by the dashed line with an arrow in FIG. 6B) is formed. Since the first transistor T1 is turned on, the bias voltage amplitude signal may be applied to the second electrode of the first capacitor C1. The first capacitor C1 is charged at the display stage of the former frame of image, and the first electrode (second node N2) of the first capacitor C1 and the second electrode of the first capacitor C1 are balanced in potential. When the bias voltage amplitude signal is applied to the second electrode of the first capacitor C1, due to a bootstrap effect of the first capacitor C1, the potential of the first electrode (second node N2) of the first capacitor C1 is increased, thereby making the potential of the second node N2 greater than VDD. Therefore, the bias voltage is applied to the light emitting element L1, which facilitates the elimination of defects of the light emitting element L1 accumulated at a stage of emitting light of the former frame of image (the stage when forward voltages are applied), thereby improving the aging of the light emitting element L1 and prolonging the service life of the light emitting element L1. For example, in a display device, when the pixel circuits 10 are arranged in an array, the gates of the third transistor T3 in the Nth row (N is an integer greater than 1) are connected with the scan line (or scan signal terminal Vscan(n)) in the Nth row to receive the scan signal, and the gates and/or the second electrodes of the first transistors T1 in the Nth row are connected with the scan line (or scan signal terminal Vscan(n−1)) in the (N−1)th row to receive the scan signals in the (N−1)th row as the bias starting signal and/or bias voltage amplitude signal. Compared with a traditional display panel, in this way, there is no need to provide any new signals, and the circuit structure is simple and easy to implement.

After the bias stage 2, the potential of the second node N2 is that of the reset voltage. The light emitting element L1 is reverse biased, thereby eliminating defects of the light emitting element L1 accumulated at the stage when forward voltages are applied, and prolonging the service life of the light emitting element L1 effectively. Since the high-level duration of the bias starting signal is short, beyond the ability of distinguishing by human eye, the display effect of the display device which adopts the above-mentioned pixel circuit 10 would not be influenced.

At the data writing stage 3, the scan signal (provided by the scan signal terminal Vscan(n)) and the data signal (provided by the data signal terminal Vdata) are input to switch on the data writing circuit 200 and the driver circuit 100. The data writing circuit 200 writes the data signal to the driver circuit 100, the storage circuit 300 stores the data signal, and the light emitting element L1 emits light according to the drive current.

As shown in FIGS. 5 and 6C, at the data writing stage 3, the third transistor T3 is turned on by the high level of the scan signal, the second transistor T2 is turned on by the high level of the first node N1; at the same time, the first transistor T1 is turned off by the low level of the bias starting signal, and the fourth transistor T4 is turned off by the low level of the reset signal.

As shown in FIG. 6C, at the data writing stage 3, a data writing path (as shown by the dashed line with an arrow in FIG. 6C) is formed, and the second capacitor C2 is charged by the data signal through the third transistor T3. When the voltage difference between the first node N1 and the second node N2 is greater than Vth, the second transistor T2 is turned on, thereby making the light emitting element L1 emit light under the action of the drive current. It should be noted that Vth represents the threshold voltage of the second transistor T2. Since the description is made by taking the N-type second transistor T2 as an example in the present embodiment, the threshold voltage Vth may be positive. In other embodiments, if the second transistor T2 is of the P type, the threshold voltage Vth may have a negative value.

For example, the value of the drive current $I_{L1}$ flowing through the light emitting element L1 may be obtained according to the following formula:

$$I_{L1}=K(V_{GS}-Vth)^2.$$

In the above-mentioned formula, Vth represents the threshold voltage of the second transistor T2, $V_{GS}$ represents the voltage between the gate and the source (the first electrode herein) of the second transistor T2, and K is a constant value related to the driver transistor itself. As such, the drive current $I_{L1}$ flowing through the light emitting element L1 is related to $V_{GS}$. That is, the light emitting element L1 may emit light according to the data signal stored in the second capacitor C2.

After the data writing stage 3, the voltage information containing the data signal is stored in the second capacitor C2, and the second transistor T2 provides a drive current for the light emitting element L1 under the control of the voltage difference between the first node N1 and the second node N2, so as to make the light emitting element L1 emit light. It should be noted that in the present embodiment, at the data writing stage 3, in the pixel circuit 10, not only writing of the data signal but also light emitting is performed. In other embodiments, based on the specific circuit structure, data writing and light emitting may also be implemented at two stages respectively, and the embodiments of the present disclosure have no limitation in this aspect.

Figure 7:
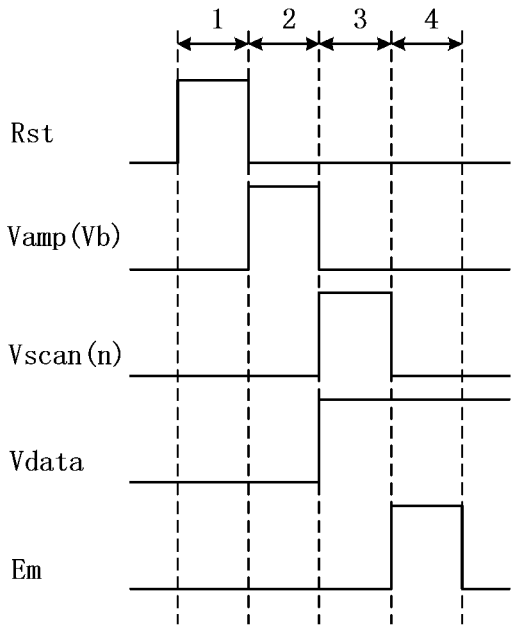
FIG. 7 is a signal timing diagram of another pixel circuit according to an embodiment of the present disclosure.

FIG. 7 is a signal timing diagram of another pixel circuit according to an embodiment of the present disclosure. Referring to FIG. 7, this signal timing is substantially the same as that shown in FIG. 5 except the light emitting stage 4. The working principle of the pixel circuit 10 shown in FIG. 4 will be explained below in combination with the signal timing diagram shown in FIG. 7, and herein the description is made by taking an example in which each transistor is an N-type transistor, but the embodiments of the present disclosure are not limited thereto.

Figure 8:
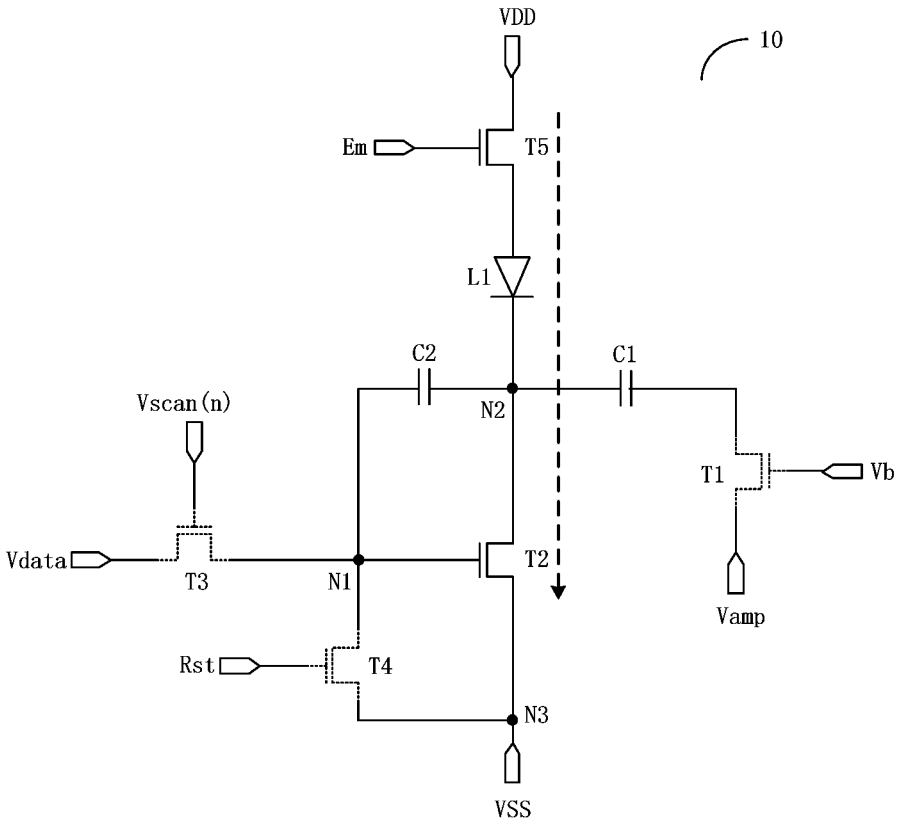
FIG. 8 is a schematic circuit diagram of the pixel circuit shown in FIG. 4 corresponding to the fourth stage in FIG. 7.

FIG. 8 is a circuit schematic diagram of the pixel circuit 10 shown in FIG. 4 corresponding to the light emitting stage 4 in FIG. 7. The transistors indicated by dashed lines in FIG. 8 mean that the transistors are in the OFF state at the corresponding stage, and the dashed line with an arrow represents a current direction of the pixel circuit 10 at the corresponding stage. The reset stage 1, the reset stage 2 and the data writing stage 3 have substantially the same working principle as the pixel circuit 10 shown in FIGS. 5 and 6A to 6C, and are not repeated herein.

At the light emitting stage 4, the light emitting control signal (provided by the light emitting control terminal Em) is input to switch on the light emitting control circuit 700, and the light emitting control circuit 700 and the driver circuit 100 apply the drive current to the light emitting element L1 to make the light emitting element L1 emit light.

As shown in FIGS. 7 and 8, at the light emitting stage 4, the fifth transistor T5 is turned on by the high level of the light emitting control signal, the second transistor T2 is turned on by the high level of the first node N1; at the same time, the first transistor T1 is turned off by the low level of the bias starting signal, the third transistor T3 is turned off by the low level of the scan signal, and the fourth transistor T4 is turned off by the low level of the reset signal.

As shown in FIG. 8, at the light emitting stage 4, a light emitting drive path (as shown by the dashed line with an arrow in FIG. 8) is formed. Since the fifth transistor T5 and the second transistor T2 are turned on, the drive current is provided for the light emitting element L1, and the light emitting element L1 emits light under the action of the drive current.

It should be noted that in the present embodiment, the light emitting element L1 emits light only at the light emitting stage 4, and does not emit light at the data writing stage 3. Data writing and light emitting are implemented at two stages respectively, which contributes to the integrity of data writing and improves the contrast of the corresponding display device.

It should be noted that as the transistors in each embodiment of the present disclosure, thin film transistors, field effect transistors or switch devices with the same characteristics may be used, and each embodiment of the present disclosure will be explained by taking the thin film transistor as an example. The source and the drain of the transistor used herein may be symmetrical in structure, so there may be no difference between the source and the drain of the transistor in structure. In each embodiment of the present disclosure, in order to distinguish two electrodes of the transistor other than the gate electrode, one electrode is directly described as the source and the other electrode is directly described as the drain.

In addition, it should be noted that the description is made by taking as an example in which the transistors in the pixel circuit 10 shown in FIGS. 3 and 4 are all N-type transistors. At this point, the first electrode may be the source and the second electrode may be the drain. As the transistors in the pixel circuit 10, P-type transistors or both P-type transistors and N-type transistors may be used, so long as the terminal polarity of the transistor of the selected type is connected correspondingly according to the terminal polarity of the corresponding transistor in the embodiments of the present disclosure, and corresponding voltage terminals and signal terminals provide corresponding high-level signals or low-level signals. When the N-type transistor is used, IGZO (Indium Gallium Zinc Oxide) may be used as an active layer of the thin film transistor. Compared with the usage of LTPS (Low Temperature Poly Silicon) or A-Si (for example, a-SiH) as the active layer of the thin film transistor, the size of the transistor may be reduced effectively and a leakage current is prevented.

At least one embodiment of the present disclosure further provides a display panel, including a plurality of pixel units arranged in an array, the pixel unit including the pixel circuit according to any one of the embodiments of the present disclosure. The reverse voltage is applied to the pixel circuit of this display panel after the OLED emits light, which facilitates the elimination of defects of the OLED accumulated at a stage when forward voltages are applied, thereby improving the aging of the OLED device and prolonging the service life of the OLED device. There is no need to provide any new signals for the display panel, so the display panel is easy to implement.

Figure 9:
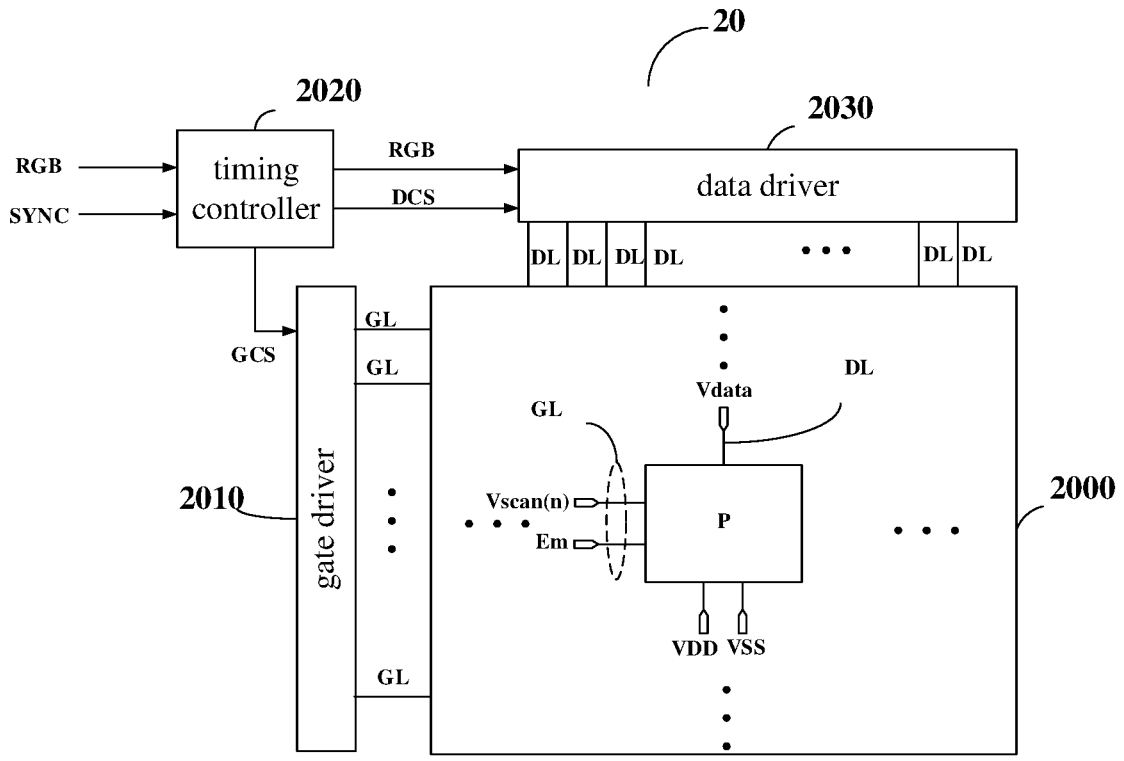
FIG. 9 is a schematic block diagram of a display panel according to an embodiment of the present disclosure.

FIG. 9 is a schematic block diagram of a display panel according to an embodiment of the present disclosure. Referring to FIG. 9, the display panel 2000 is arranged in the display device 20, and is electrically connected with a gate driver 2010 and the data driver 2030. The display device 20 further includes a timing controller 2020. The display panel 2000 includes a plurality of pixel units P which are defined by numerous scan lines GL and numerous data lines DL intersecting with the scan lines GL; the gate driver 12 is used for driving the plurality of scan lines GL; the data driver 2030 is used for driving the plural data lines DL; and the timing controller 2020 is used for processing image data RGB input from outside the display device 20, providing the processed image data RGB for the data driver 2030 and outputting the scan control signal GCS and the data control signal DCS to the gate driver 2010 and the data driver 2030, so as to control the gate driver 2010 and the data driver 2030.

For example, the display panel 2000 includes a plurality of pixel units P, including the pixel circuit 10 according to any one of the above-mentioned embodiments. For example, the pixel unit P includes the pixel circuit 10 shown in FIG. 3. For example, the pixel unit P may also include the pixel circuit as shown in FIG. 4. As shown in FIG. 9, the display panel 2000 further includes a plurality of scan lines GL and a plurality of data lines DL. For example, the pixel units P are arranged in an area where the scan lines GL intersect with the data lines DL. For example, each pixel unit P is connected to two scan lines GL (providing the scan signal and the light emitting control signal respectively), one data line DL, a first voltage line for providing a first voltage signal, and a second voltage line for providing a second voltage signal. For example, the first voltage line or the second voltage line may be substituted with the corresponding plate-shaped common electrode (for example, a common anode or cathode). It should be noted that FIG. 9 only shows part of pixel units P, scan lines GL and data lines DL.

For example, the gate driver 2010 provides a plurality of gating signals for the plurality of scan lines GL according to the plurality of scan control signals GCS from the timing controller 2020. The plurality of gating signals includes a scan signal, a light emitting control signal, etc. These signals are provided for each pixel unit P by the plurality of scan lines GL.

For example, the data driver 2030 converts the digital image data RGB input from the timing controller 2020 into data signals by using a reference gamma voltage according to the plurality of data control signals DCS from the timing controller 2020. The data driver 2030 provides the converted data signals for the plurality of data lines DL.

For example, the timing controller 2020 processes the image data RGB input from the outside to match the size and the resolution of the display panel 2000, and then provides the processed image data for the data driver 2030. The timing controller 2020 uses a synchronization signal input from the display device 20 (for example, a dot clock DCLK, a data enable signal DE, a horizontal synchronizing signal Hsync and a vertical synchronizing signal Vsync) to generate a plurality of scan control signals GCS and a plurality of data control signals DCS. The timing controller 2020 provides the generated scan control signals GCS and the data control signals DCS for the gate driver 2010 and the data driver 2030, so as to control the gate driver 2010 and the data driver 2030.

For example, the data driver 2030 may be connected with the plurality of data lines DL to provide the data signal Vdata; and the data driver 2030 may also be connected with a plurality of first voltage lines and a plurality of second voltage lines to provide the first voltage and the second voltage respectively.

For example, the gate driver 2010 and the data driver 2030 may be embodied as semiconductor chips. This display device 20 may further include other components, for example, a signal decoding circuit, a voltage converting circuit, or the like, which may be conventional components, and are not described in detail herein.

For example, the display panel 2000 may be applied to any product or component with a display function, such as an electronic paper, a mobile phone, a tablet PC, a TV, a display, a laptop, a digital photo frame, a navigator, or the like.

Figure 10:
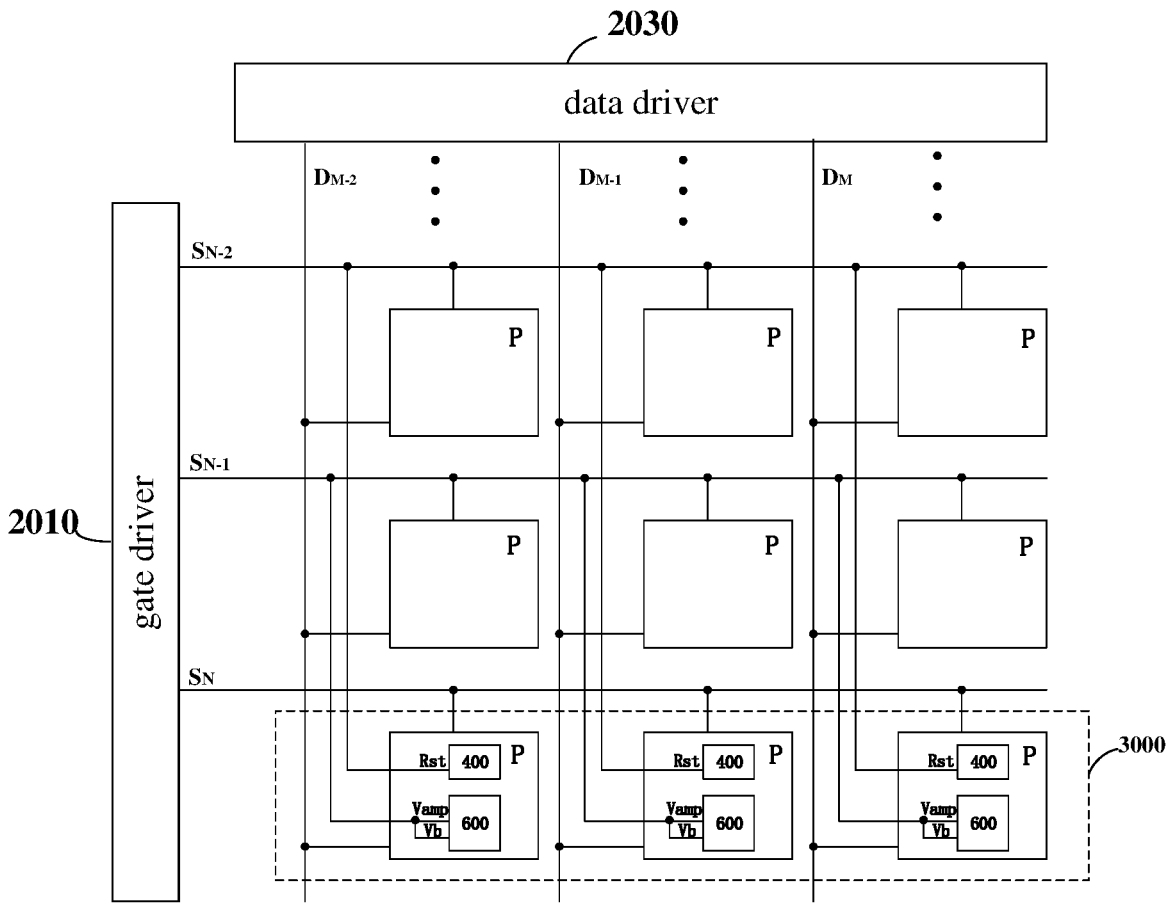
FIG. 10 is a schematic block diagram of another display panel according to an embodiment of the present disclosure.

FIG. 10 is a schematic block diagram of another display panel according to an embodiment of the present disclosure. Referring to FIG. 10, the plurality of pixel units P is arranged in a plurality of rows, only the specific connection of the pixel units P in the exemplary area 3000 is shown and other pixel units P have similar connections.

For example, the data writing circuits 200 of the pixel circuits 10 in the Nth (N is an integer greater than 2) row of pixel units P (pixel units P in the exemplary area 3000) are connected to a scan line $S_N$, and the reset circuits 400 of the pixel circuit 10 in the Nth row of pixel units P are connected to another scan line $S_{N-2}$. For example, this scan line $S_{N-2}$ is further connected with the data writing circuits 200 of the pixel circuit 10 in the (N−2)th row of pixel units P. Herein, the data writing circuit 200 is not shown in drawings. By means of signal multiplexing, there is no need to provide any new signals, and the circuit has a simple structure and is easy to implement.

For another example, as shown in FIG. 10, the data writing circuits 200 of the pixel circuits 10 in the Nth (N is an integer greater than 1) row of pixel units P are connected to a scan line $S_N$, and the bias circuits 600 of the pixel circuit 10 in the Nth row of pixel units P are connected to another scan line $S_{N-1}$. For example, this scan line $S_{N-1}$ is further connected with the data writing circuits 200 of the pixel circuit 10 in the (N−1)th row of pixel units P.

For example, each column of data lines $D_M$, $D_{M-1}$, $D_{M-2}$ are connected with the data writing circuits 200 in this column of pixel circuits 10 to provide data signals.

At least one embodiment of the present disclosure further provides a method for driving a pixel circuit, e.g., the pixel circuit 10 according to the embodiments of the present disclosure. A reverse voltage may be applied to this pixel circuit after the OLED emits light, which facilitates the elimination of defects of the OLED accumulated at a stage when forward voltages are applied, thereby improving the aging of the OLED device and prolonging the service life of the OLED device. There is no need to provide any new signal for the display panel, and the method is easy to implement.

For example, in an example, this driving method includes the following operations.

At the bias stage, the bias starting signal is input to switch on the bias circuit 600. The bias circuit 600 applies the bias voltage to the second terminal 520 of the light emitting element 500 according to the bias voltage amplitude signal, so as to reverse bias the light emitting element 500.

At the data writing stage, the scan signal and the data signal are input to switch on the data writing circuit 200 and the driver circuit 100. The data writing circuit 200 writes the data signal to the driver circuit 100, the storage circuit 300 stores the data signal, and the light emitting element 500 emits light according to the drive current.

For example, in the case where the pixel circuit 10 further includes a reset circuit 400, this driving method further includes a reset stage. At the reset stage, the reset signal is input to switch on the reset circuit 400, and the reset circuit 400 applies the reset voltage to the control terminal 130 of the driver circuit 100 and the first terminal 310 of the storage circuit 300, so as to reset the driver circuit 100 and the storage circuit 300.

For example, in another example, this driving method includes the following operations.

At the bias stage, the bias starting signal is input to switch on the bias circuit 600. The bias circuit 600 applies the bias voltage to the second terminal 520 of the light emitting element 500 according to the bias voltage amplitude signal, so as to reverse bias the light emitting element 500.

At the data writing stage, the scan signal and the data signal are input to switch on the data writing circuit 200. The data writing circuit 200 writes the data signal to the driver circuit 100, and the storage circuit 300 stores the data signal.

At the light emitting stage, the light emitting control signal is input to switch on the light emitting control circuit 700, and the light emitting control circuit 700 and the driver circuit 100 apply the drive current to the light emitting element 500 to make the light emitting element 500 emit light.

It should be noted that in this example, the light emitting element 500 does not emit light at the data writing stage. For example, in this example, this driving method may further include a reset stage, the operation of which may refer to the above-mentioned contents and is not repeated herein.

It should be noted that the detailed description of the driving method may refer to the description of the working principle of the pixel circuit 10 in the embodiments of the present disclosure, which will not be repeated herein.

The following statements should be noted:

(1) The accompanying drawings involve only the structure(s) in connection with the embodiment(s) of the present disclosure, and other structure(s) can be referred to common design(s).

(2) In case of no conflict, features in one embodiment or in different embodiments can be combined to obtain new embodiments.

What are described above is related to the illustrative embodiments of the disclosure only and not limitative to the scope of the disclosure; the scopes of the disclosure are defined by the accompanying claims.

What is claimed is:

1. A pixel circuit, comprising a driver circuit, a data writing circuit, a storage circuit, a light emitting element, a bias circuit, and a reset circuit, wherein the driver circuit comprises a control terminal, a first terminal, and a second terminal, and the driver circuit is configured to control a drive current for driving the light emitting element to emit light, the second terminal of the driver circuit receives a first voltage signal of a first voltage terminal;

the data writing circuit is connected with the control terminal of the driver circuit, and the data writing circuit is configured to write a data signal to the control terminal of the driver circuit in response to a scan signal;

a first terminal of the storage circuit is connected with the control terminal of the driver circuit, a second terminal of the storage circuit is connected with the first terminal of the driver circuit, and the storage circuit is configured to store the data signal written by the data writing circuit;

a first terminal of the light emitting element receives a second voltage signal of a second voltage terminal, a second terminal of the light emitting element is connected with the first terminal of the driver circuit, and the light emitting element is configured to emit light according to the drive current;

the bias circuit is connected with the second terminal of the light emitting element, and the bias circuit is configured to apply, according to a bias voltage amplitude signal, a bias voltage to the second terminal of the light emitting element in response to a bias starting signal, so as to reverse bias the light emitting element; and the reset circuit is connected with the control terminal of the driver circuit, and the reset circuit is configured to apply a reset voltage to the control terminal of the driver circuit in response to a reset signal.

2. The pixel circuit according to claim 1, wherein the bias circuit comprises a first capacitor and a first transistor, a first electrode of the first capacitor is configured to be connected with the second terminal of the light emitting element, and a second electrode of the first capacitor is configured to be connected with a first electrode of the first transistor, and a gate of the first transistor is configured to be connected with a bias starting terminal to receive the bias starting signal, and a second electrode of the first transistor is configured to be connected with a bias voltage amplitude terminal to receive the bias voltage amplitude signal.

3. The pixel circuit according to claim 2, wherein the driver circuit comprises a second transistor, a gate of the second transistor is used as the control terminal of the driver circuit, a first electrode of the second transistor is used as the first terminal of the driver circuit, and a second electrode of the second transistor is used as the second terminal of the driver circuit.

4. The pixel circuit according to claim 2, wherein the data writing circuit comprises a third transistor, a gate of the third transistor is configured to be connected with a scan signal terminal to receive the scan signal, a first electrode of the third transistor is configured to be connected with a data signal terminal to receive the data signal, and a second electrode of the third transistor is configured to be connected with the control terminal of the driver circuit.

5. The pixel circuit according to claim 2, wherein the storage circuit comprises a second capacitor, a first electrode of the second capacitor is used as the first terminal of the storage circuit, and a second electrode of the second capacitor is used as the second terminal of the storage circuit.

6. The pixel circuit according to claim 1, wherein the driver circuit comprises a second transistor, a gate of the second transistor is used as the control terminal of the driver circuit, a first electrode of the second transistor is used as the first terminal of the driver circuit, and a second electrode of the second transistor is used as the second terminal of the driver circuit.

7. The pixel circuit according to claim 6, wherein the data writing circuit comprises a third transistor, a gate of the third transistor is configured to be connected with a scan signal terminal to receive the scan signal, a first electrode of the third transistor is configured to be connected with a data signal terminal to receive the data signal, and a second electrode of the third transistor is configured to be connected with the control terminal of the driver circuit.

8. The pixel circuit according to claim 6 wherein the storage circuit comprises a second capacitor, a first electrode of the second capacitor is used as the first terminal of the storage circuit, and a second electrode of the second capacitor is used as the second terminal of the storage circuit.

9. The pixel circuit according to claim 1, wherein the data writing circuit comprises a third transistor, a gate of the third transistor is configured to be connected with a scan signal terminal to receive the scan signal, a first electrode of the third transistor is configured to be connected with a data signal terminal to receive the data signal, and a second electrode of the third transistor is configured to be connected with the control terminal of the driver circuit.

10. The pixel circuit according to claim 1, wherein the storage circuit comprises a second capacitor, a first electrode of the second capacitor is used as the first terminal of the storage circuit, and a second electrode of the second capacitor is used as the second terminal of the storage circuit.

11. The pixel circuit according to claim/f wherein the reset circuit comprises a fourth transistor, a gate of the fourth transistor is configured to be connected with a reset terminal to receive the reset signal, a first electrode of the fourth transistor is connected with the control terminal of the driver circuit, and a second electrode of the fourth transistor is configured to be connected with the first voltage terminal to receive the reset voltage.

12. The pixel circuit according to claim 1, further comprising a light emitting control circuit, wherein the light emitting control circuit is connected with the first terminal of the light emitting element, and the light emitting control circuit is configured to apply the second voltage signal of the second voltage terminal to the first terminal of the light emitting element in response to a light emitting control signal.

13. The pixel circuit according to claim 12, wherein the light emitting control circuit comprises a fifth transistor, a gate of the fifth transistor is configured to be connected with a light emitting control terminal to receive the light emitting control signal, a first electrode of the fifth transistor is configured to be connected with the second voltage terminal to receive the second voltage signal, and a second electrode of the fifth transistor is configured to be connected with the first terminal of the light emitting element.

14. A method for driving the pixel circuit according to claim 12, comprising:

inputting the bias starting signal to switch on the bias circuit, applying, by the bias circuit, the bias voltage to the second terminal of the light emitting element according to the bias voltage amplitude signal, so as to reverse bias the light emitting element;

inputting the scan signal and the data signal to switch on the data writing circuit, writing, by the data writing circuit, the data signal to the driver circuit, and storing the data signal by the storage circuit; and inputting the light emitting control signal switch on the light emitting control circuit, and applying, by the light emitting control circuit and the driver circuit, the drive current to the light emitting element to make the light emitting element emit light.

15. A display panel, comprising a plurality of pixel units arranged in an array, each pixel unit comprising a pixel circuit, wherein the pixel circuit comprises a driver circuit, a data writing circuit, a storage circuit, a light emitting element, a bias circuit, and a reset circuit, and wherein the driver circuit comprises a control terminal, a first terminal, and a second terminal, and the driver circuit is configured to control a drive current for driving the light emitting element to emit light, the second terminal of the driver circuit receives a first voltage signal of a first voltage terminal;

the data writing circuit is connected with the control terminal of the driver circuit, and the data writing circuit is configured to write a data signal to the control terminal of the driver circuit in response to a scan signal;

a first terminal of the storage circuit is connected with the control terminal of the driver circuit, a second terminal of the storage circuit is connected with the first terminal of the driver circuit, and the storage circuit is configured to store the data signal written by the data writing circuit, a first terminal of the light emitting element receives a second voltage signal of a second voltage terminal, a second terminal of the light emitting element is connected with the first terminal of the driver circuit, and the light emitting element is configured to emit light according to the drive current;

the bias circuit is connected with the second terminal of the light emitting element, and the bias circuit is configured to apply, according to a bias voltage amplitude signal, a bias voltage to the second terminal of the light emitting element in response to a bias starting signal, so as to reverse bias the light emitting element; and the reset circuit is connected with the control terminal of the driver circuit, and the reset circuit is configured to apply a reset voltage to the control terminal of the driver circuit in response to a reset signal.

16. The display panel according to claim 15, further comprising a plurality of scan lines, wherein a data writing circuit in an Nth row of the pixel units is connected with a scan line in the Nth row to receive the scan signal, and a bias circuit in the Nth row of the pixel units is connected with a scan line in an (N−1)th row to receive a scan signal of the (N−1)th row as at least one selected from a group consisting of the bias starting signal and the bias voltage amplitude signal, wherein N is an integer greater than 1.

17. The display panel according to claim 16, wherein a reset circuit in the Nth row of the pixel units is connected with a scan line in a (N−2)th row to receive a scan signal of the (N−2)th row as the reset signal, and N is an integer greater than 2.

18. A method for driving a pixel circuit, wherein the pixel circuit comprises a driver circuit, a data writing circuit, a storage circuit, a light emitting element, a bias circuit, and a reset circuit, and wherein the driver circuit comprises a control terminal, a first terminal, and a second terminal, and the driver circuit is configured to control a drive current for driving the light emitting element to emit light, the second terminal of the driver circuit receives a first voltage signal of a first voltage terminal;

the data writing circuit is connected with the control terminal of the driver circuit, and the data writing circuit is configured to write a data signal to the control terminal of the driver circuit in response to a scan signal;

a first terminal of the storage circuit is connected with the control terminal of the driver circuit, a second terminal of the storage circuit is connected with the first terminal of the driver circuit and the storage circuit is configured to store the data signal written by the data writing circuit;

first terminal of the light emitting element receives a second voltage of a second voltage terminal, a second terminal of the light emitting element is connected with the first terminal of the driver circuit and the light emitting element is configured to emit light according to the drive current;

the bias circuit is connected with the second terminal of the light emitting element, and the bias circuit is configured to apply, according to a bias voltage amplitude signal, a bias voltage to the second terminal of the light emitting element in response to a bias starting signal, so as to reverse bias the light emitting element; and the reset circuit is connected with the control terminal of the driver circuit, and the reset circuit is configured to apply a reset voltage to the control terminal of the driver circuit in response to a reset signal, the method comprising:

inputting the bias starting signal to switch on the bias circuit, and applying, by the bias circuit, the bias voltage to the second terminal of the light emitting element according to the bias voltage amplitude signal, so as to reverse bias the light emitting element; and inputting the scan signal and the data signal to switch on the data writing circuit and the driver circuit, writing, by the data writing circuit, the data signal to the driver circuit, storing the data signal by the storage circuit, and emitting light by the light emitting element according to the drive current.

19. The method for driving the pixel circuit according to claim 18, the method further comprising:

inputting the reset signal to switch on the reset circuit, and applying, by the reset circuit, the reset voltage to the control terminal of the driver circuit and the first terminal of the storage circuit, so as to reset the driver circuit and the storage circuit.

* * * * *